US011672276B2

(12) United States Patent
Yilmaz et al.

(10) Patent No.: US 11,672,276 B2
(45) Date of Patent: Jun. 13, 2023

(54) AEROSOL PROVISION ARTICLE

(71) Applicant: BRITISH AMERICAN TOBACCO (INVESTMENTS) LIMITED, London (GB)

(72) Inventors: Ugurhan Yilmaz, London (GB); Dominic Woodcock, London (GB)

(73) Assignee: British American Tobacco (Investments) Limited, London (GB)

( * ) Notice: Subject to any disclaimer, the term of this patent is extended or adjusted under 35 U.S.C. 154(b) by 224 days.

(21) Appl. No.: 16/346,940

(22) PCT Filed: Oct. 27, 2017

(86) PCT No.: PCT/EP2017/077633
§ 371 (c)(1),
(2) Date: May 2, 2019

(87) PCT Pub. No.: WO2018/083037
PCT Pub. Date: May 11, 2018

(65) Prior Publication Data

US 2019/0320718 A1 Oct. 24, 2019

(30) Foreign Application Priority Data

Nov. 2, 2016 (GB) ..... 1618481

(51) Int. Cl.
*A24F 47/00* (2020.01)
*A24B 15/16* (2020.01)
(Continued)

(52) U.S. Cl.
CPC ..... *A24F 40/30* (2020.01); *A24B 13/00* (2013.01); *A24B 15/167* (2016.11);
(Continued)

(58) Field of Classification Search
None
See application file for complete search history.

(56) References Cited

U.S. PATENT DOCUMENTS 4,083,372 A 4/1978 Boden
4,284,089 A 8/1981 Ray
(Continued)

FOREIGN PATENT DOCUMENTS

AT 507187 A4 3/2010
AT 507187 B1 3/2010
(Continued)

OTHER PUBLICATIONS

International Search Report and Written Opinion, Application No. PCT/EP2017/077633, dated Feb. 5, 2018, 8 pages.
(Continued)

*Primary Examiner* — Dennis R Cordray
(74) *Attorney, Agent, or Firm* — Patterson Thuente, P.A.

(57) ABSTRACT

There is described an aerosol provision article for use with an aerosol provision device for generating an inhalable medium including an aerosol. The aerosol provision article includes a first chamber for containing a first substance that is heatable to generate an aerosol; a conduit that extends through the first chamber, the conduit having an inlet through which aerosol generated from the first substance can enter the conduit and an outlet through which the aerosol can exit the conduit and a second chamber for receiving a second substance, wherein the second chamber is downstream of the outlet of the conduit. The article is arranged such that in use aerosol exiting the outlet of the conduit passes through the second substance received in the second chamber, and wherein the cross-sectional area of the conduit increases at or towards the outlet.

23 Claims, 2 Drawing Sheets

(51) Int. Cl.

| | |
|---|---|
| ***A24B 13/00*** | (2006.01) |
| ***H05B 6/10*** | (2006.01) |
| ***A24F 40/30*** | (2020.01) |
| ***A24B 15/167*** | (2020.01) |
| ***A24F 40/485*** | (2020.01) |
| *A24F 40/10* | (2020.01) |
| *A24F 40/20* | (2020.01) |

(52) U.S. Cl.

CPC ..... *A24F 40/485* (2020.01); *H05B 6/108* (2013.01); *A24F 40/10* (2020.01); *A24F 40/20* (2020.01)

(56) References Cited

U.S. PATENT DOCUMENTS

| | | | |
|---|---|---|---|
| 4,756,318 | A | 7/1988 | Clearman et al. |
| 4,907,606 | A | 3/1990 | Lilja et al. |
| 4,913,169 | A | 4/1990 | Templeton |
| 5,027,836 | A | 7/1991 | Shannon et al. |
| 5,027,839 | A | 7/1991 | Appell |
| 5,105,834 | A | 4/1992 | Saintsing et al. |
| 5,115,820 | A | 5/1992 | Hauser et al. |
| 5,203,355 | A | 4/1993 | Clearman et al. |
| 5,327,915 | A | 7/1994 | Porenski et al. |
| 5,613,505 | A | 3/1997 | Campbell et al. |
| 5,820,967 | A | 10/1998 | Gadkaree |
| 5,950,619 | A | 9/1999 | Van Der Linden et al. |
| 6,095,558 | A | 8/2000 | Bayer et al. |
| 6,814,786 | B1 | 11/2004 | Zhuang et al. |
| 6,988,496 | B1 | 1/2006 | Eicher et al. |
| 7,160,366 | B2 | 1/2007 | Blackburn et al. |
| 7,699,052 | B2 | 4/2010 | Schiewe et al. |
| 8,536,606 | B2 | 9/2013 | Kim |
| 8,833,364 | B2 | 9/2014 | Buchberger |
| 8,997,753 | B2 | 4/2015 | Li et al. |
| 9,259,031 | B2 | 2/2016 | Branton et al. |
| D761,998 | S | 7/2016 | Pinder |
| D768,915 | S | 10/2016 | Wright et al. |
| 9,456,632 | B2 | 10/2016 | Hon |
| D782,728 | S | 3/2017 | Pinder |
| D782,729 | S | 3/2017 | Wright et al. |
| D805,684 | S | 12/2017 | Thuery |
| 9,894,930 | B2 * | 2/2018 | Bonici ..... A24D 1/22 |
| D815,342 | S | 4/2018 | Sutton |
| D818,635 | S | 5/2018 | Pinder et al. |
| D818,638 | S | 5/2018 | Wright et al. |
| D825,099 | S | 8/2018 | Wright et al. |
| D825,103 | S | 8/2018 | Wright et al. |
| 10,226,077 | B2 * | 3/2019 | Matsumoto ..... A24F 40/485 |
| 10,375,996 | B2 | 8/2019 | Aoun et al. |
| 10,426,199 | B2 | 10/2019 | Turner et al. |
| 2004/0194792 | A1 | 10/2004 | Zhuang et al. |
| 2005/0133051 | A1 | 6/2005 | Luan et al. |
| 2005/0133054 | A1 | 6/2005 | Fournier et al. |
| 2006/0144412 | A1 | 7/2006 | Mishra et al. |
| 2006/0201524 | A1 | 9/2006 | Zhang et al. |
| 2007/0023056 | A1 | 2/2007 | Cantrell et al. |
| 2007/0215168 | A1 | 9/2007 | Banerjee et al. |
| 2008/0092912 | A1 | 4/2008 | Robinson et al. |
| 2008/0110470 | A1 | 5/2008 | Zhuang et al. |
| 2008/0241255 | A1 | 10/2008 | Rose et al. |
| 2010/0024834 | A1 | 2/2010 | Oglesby et al. |
| 2011/0088707 | A1 | 4/2011 | Hajaligol |
| 2011/0226236 | A1 | 9/2011 | Buchberger |
| 2012/0006342 | A1 | 1/2012 | Rose et al. |
| 2012/0006346 | A1 | 1/2012 | Inagaki |
| 2012/0042885 | A1 | 2/2012 | Stone et al. |
| 2012/0199663 | A1 | 8/2012 | Qiu |
| 2012/0255567 | A1 | 10/2012 | Rose et al. |
| 2012/0312314 | A1 | 12/2012 | Plakidis et al. |
| 2012/0318882 | A1 | 12/2012 | Abehasera |
| 2013/0014772 | A1 | 1/2013 | Liu |
| 2013/0056013 | A1 | 3/2013 | Terry et al. |
| 2013/0133675 | A1 | 5/2013 | Shinozaki et al. |
| 2013/0160779 | A1 | 6/2013 | Chida et al. |
| 2013/0160780 | A1 | 6/2013 | Matsumoto et al. |
| 2013/0192616 | A1 | 8/2013 | Tucker et al. |
| 2013/0192620 | A1 | 8/2013 | Tucker et al. |
| 2013/0298905 | A1 | 11/2013 | Levin et al. |
| 2013/0333700 | A1 | 12/2013 | Buchberger |
| 2014/0048085 | A1 | 2/2014 | Cox |
| 2014/0076340 | A1 | 3/2014 | Kizer et al. |
| 2014/0123989 | A1 | 5/2014 | LaMothe |
| 2014/0159250 | A1 | 6/2014 | Nickerson |
| 2014/0166029 | A1 | 6/2014 | Weigensberg et al. |
| 2014/0190502 | A1 | 7/2014 | Liu |
| 2014/0261486 | A1 | 9/2014 | Potter et al. |
| 2014/0299125 | A1 | 10/2014 | Buchberger |
| 2014/0305449 | A1 | 10/2014 | Plojoux et al. |
| 2014/0356607 | A1 | 12/2014 | Woodcock |
| 2015/0027454 | A1 | 1/2015 | Li et al. |
| 2015/0128973 | A1 | 5/2015 | Li et al. |
| 2015/0196059 | A1 | 7/2015 | Liu |
| 2015/0257447 | A1 | 9/2015 | Sullivan |
| 2015/0264979 | A1 | 9/2015 | Thorens et al. |
| 2015/0342256 | A1 | 12/2015 | Chen |
| 2016/0020224 | A1 | 1/2016 | Kawamura et al. |
| 2016/0073692 | A1 | 3/2016 | Alarcon et al. |
| 2016/0120224 | A1 | 5/2016 | Mishra |
| 2016/0135505 | A1 | 5/2016 | Li et al. |
| 2016/0143360 | A1 | 5/2016 | Sanchez et al. |
| 2016/0174610 | A1 | 6/2016 | Kuczaj |
| 2016/0205992 | A1 | 7/2016 | Bell et al. |
| 2016/0227837 | A1 | 8/2016 | Hammel et al. |
| 2016/0255879 | A1 | 9/2016 | Paprocki et al. |
| 2016/0324216 | A1 | 11/2016 | Li et al. |
| 2016/0353801 | A1 * | 12/2016 | Zinovik ..... A61M 11/042 |
| 2017/0042221 | A1 | 2/2017 | England |
| 2017/0086506 | A1 | 3/2017 | Rado |
| 2017/0095624 | A1 | 4/2017 | Davidson et al. |
| 2017/0143038 | A1 | 5/2017 | Dickens |
| 2017/0156402 | A1 | 6/2017 | Liu |
| 2017/0238612 | A1 | 8/2017 | Daryani et al. |
| 2017/0251727 | A1 | 9/2017 | Nielsen |
| 2017/0280769 | A1 | 10/2017 | Li et al. |
| 2017/0319799 | A1 | 11/2017 | Yamada et al. |
| 2017/0347706 | A1 | 12/2017 | Aoun et al. |
| 2018/0027882 | A1 | 2/2018 | Hepworth et al. |
| 2018/0235276 | A1 | 8/2018 | Zuleta et al. |
| 2018/0279667 | A1 | 10/2018 | McAdam et al. |
| 2018/0279678 | A1 | 10/2018 | Hepworth et al. |
| 2018/0325174 | A1 | 11/2018 | Sutton |
| 2018/0360122 | A1 | 12/2018 | Aoun et al. |
| 2018/0368478 | A1 | 12/2018 | Golovanova et al. |
| 2019/0230990 | A1 | 8/2019 | Hepworth |
| 2019/0254343 | A1 | 8/2019 | Hepworth et al. |
| 2019/0320725 | A1 | 10/2019 | England |

FOREIGN PATENT DOCUMENTS

| | | | |
|---|---|---|---|
| CA | 885796 | A | 11/1971 |
| CA | 2330782 | A1 | 7/2002 |
| CA | 2925645 | A1 | 4/2015 |
| CA | 2940842 | | 9/2015 |
| CN | 1054887 | A | 10/1991 |
| CN | 101433818 | A | 5/2009 |
| CN | 101557728 | A | 10/2009 |
| CN | 102264249 | A | 11/2011 |
| CN | 102834027 | A | 12/2012 |
| CN | 103315402 | A | 9/2013 |
| CN | 103892467 | A | 7/2014 |
| CN | 203762287 | U | 8/2014 |
| CN | 104068474 | A | 10/2014 |
| CN | 104284606 | A | 1/2015 |
| CN | 104302197 | A | 1/2015 |
| CN | 204273243 | U | 4/2015 |
| CN | 204317492 | U | 5/2015 |
| CN | 104770876 | A | 7/2015 |
| CN | 204653789 | U | 9/2015 |
| CN | 104957779 | A | 10/2015 |
| CN | 105357995 | A | 2/2016 |
| CN | 105394816 | | 3/2016 |
| CN | 105792688 | A | 7/2016 |

(56) References Cited

FOREIGN PATENT DOCUMENTS

| | | | |
|---|---|---|---|
| CN | 105962423 | A | 9/2016 |
| DE | 2940535 | A1 | 10/1980 |
| EA | 019736 | B1 | 5/2014 |
| EP | 0174645 | A2 | 3/1986 |
| EP | 0254551 | A1 | 1/1988 |
| EP | 0305788 | A1 | 3/1989 |
| EP | 0307118 | A1 | 3/1989 |
| EP | 0352106 | A2 | 1/1990 |
| EP | 0535695 | A2 | 4/1993 |
| EP | 0585016 | A1 | 3/1994 |
| EP | 0845220 | A1 | 6/1998 |
| EP | 1468618 | A1 | 10/2004 |
| EP | 2489391 | A1 | 8/2012 |
| EP | 2625974 | A1 | 8/2013 |
| EP | 2625975 | A1 | 8/2013 |
| EP | 2399637 | B1 | 10/2014 |
| EP | 2787848 | A1 | 10/2014 |
| EP | 2989912 | A1 | 3/2016 |
| EP | 3127443 | A1 | 2/2017 |
| GB | 2529201 | | 2/2016 |
| JP | S4742449 | Y1 | 12/1972 |
| JP | S488231 | B1 | 3/1973 |
| JP | S48008231 | B | 3/1973 |
| JP | S60237982 | A | 11/1985 |
| JP | S63193499 | U | 12/1988 |
| JP | H0664983 | A | 3/1994 |
| JP | 2001120250 | A | 5/2001 |
| JP | 2009191148 | A | 8/2009 |
| JP | 2010506594 | A | 3/2010 |
| JP | 2012506263 | A | 3/2012 |
| JP | 5247711 | B2 | 7/2013 |
| JP | 2013545474 | A | 12/2013 |
| JP | 2014511175 | A | 5/2014 |
| JP | 2014520542 | A | 8/2014 |
| JP | 2014529996 | A | 11/2014 |
| JP | 2015504667 | A | 2/2015 |
| JP | 2015509718 | A | 4/2015 |
| JP | 5714637 | B2 | 5/2015 |
| JP | 2015513393 | A | 5/2015 |
| JP | 2017511703 | A | 4/2017 |
| JP | 2017529896 | A | 10/2017 |
| JP | 2017538398 | A | 12/2017 |
| JP | 2018512117 | A | 5/2018 |
| KR | 20120053521 | A | 5/2012 |
| KR | 20130052119 | A | 5/2013 |
| KR | 20140118982 | A | 10/2014 |
| RU | 122254 | U1 | 11/2012 |
| RU | 2570499 | C2 | 12/2015 |
| RU | 2576015 | C2 | 2/2016 |
| RU | 2587073 | C2 | 6/2016 |
| WO | WO-9748293 | A1 | 12/1997 |
| WO | WO-9748296 | A1 | 12/1997 |
| WO | WO-9828994 | A1 | 7/1998 |
| WO | WO-0130184 | A1 | 5/2001 |
| WO | WO-03008068 | A1 | 1/2003 |
| WO | WO-03034847 | A1 | 5/2003 |
| WO | WO-03056949 | A1 | 7/2003 |
| WO | WO-2004086888 | A2 | 10/2004 |
| WO | WO-2004087309 | A1 | 10/2004 |
| WO | WO-2006048766 | A1 | 5/2006 |
| WO | WO-2006070291 | A2 | 7/2006 |
| WO | WO-2006072889 | A1 | 7/2006 |
| WO | WO-2006089404 | A1 | 8/2006 |
| WO | WO-2006097852 | A1 | 9/2006 |
| WO | WO-2006103404 | A1 | 10/2006 |
| WO | WO-2006109189 | A1 | 10/2006 |
| WO | WO-2007031876 | A2 | 3/2007 |
| WO | WO-2007036814 | A2 | 4/2007 |
| WO | 2007054167 | A1 | 5/2007 |
| WO | WO-2007069093 | A2 | 6/2007 |
| WO | WO-2008108889 | A1 | 9/2008 |
| WO | 2011034723 | A1 | 3/2011 |
| WO | 2011045609 | A1 | 4/2011 |
| WO | 2011160788 | A1 | 12/2011 |
| WO | WO-2012106739 | A1 | 8/2012 |
| WO | 2012134380 | A1 | 10/2012 |
| WO | WO-2012168699 | A1 | 12/2012 |
| WO | WO-2013034458 | A1 | 3/2013 |
| WO | WO-2013083638 | A1 | 6/2013 |
| WO | WO-2013098405 | A2 | 7/2013 |
| WO | WO-2013102309 | A1 | 7/2013 |
| WO | WO-2013120565 | A2 | 8/2013 |
| WO | WO-2013155645 | A1 | 10/2013 |
| WO | WO-2013164705 | A1 | 11/2013 |
| WO | WO-2014116974 | A1 | 7/2014 |
| WO | WO 2014/140273 | A2 * | 9/2014 |
| WO | WO-2014136872 | A1 | 9/2014 |
| WO | WO-2014139611 | A1 | 9/2014 |
| WO | WO-2014140320 | A1 | 9/2014 |
| WO | WO-2014150773 | A1 | 9/2014 |
| WO | WO-2014159250 | A1 | 10/2014 |
| WO | 2014187763 | A1 | 11/2014 |
| WO | 2015038981 | A2 | 3/2015 |
| WO | WO-2015046385 | A1 | 4/2015 |
| WO | WO-2015062983 | A2 | 5/2015 |
| WO | WO-2015128499 | A1 | 9/2015 |
| WO | WO-2015179388 | A1 | 11/2015 |
| WO | WO-2015188348 | A1 | 12/2015 |
| WO | 2016005602 | A1 | 1/2016 |
| WO | WO-2016024083 | A1 | 2/2016 |
| WO | 2016050244 | A1 | 4/2016 |
| WO | WO-2016062777 | A1 | 4/2016 |
| WO | 2016079729 | A1 | 5/2016 |
| WO | WO2016075748 | A1 * | 5/2016 |
| WO | WO-2016075748 | A1 | 5/2016 |
| WO | WO-2016121143 | A1 | 8/2016 |
| WO | WO-2016124740 | A1 | 8/2016 |
| WO | WO-2016124741 | A1 | 8/2016 |
| WO | WO-2016135331 | A1 | 9/2016 |
| WO | WO 2016135342 | | 9/2016 |
| WO | WO-2016135342 | A3 | 10/2016 |
| WO | WO-2016179376 | A1 | 11/2016 |
| WO | 2017055584 | A1 | 4/2017 |
| WO | 2017068100 | A1 | 4/2017 |
| WO | 2018033649 | A1 | 2/2018 |

OTHER PUBLICATIONS

Communication pursuant to Article 94(3) EPC for Application No. 15793718.6, dated Dec. 20, 2018, 5 pages.

Communication pursuant to Article 94(3) EPC for Application No. 15793718.6, dated Apr. 1, 2020, 13 pages.

Communication pursuant to Article 94(3) EPC for Application No. 16709731.0, dated Sep. 30, 2019, 28 pages.

Communication pursuant to Article 94(3) EPC for Application No. 18190846.8, dated Apr. 1, 2020, 5 pages.

Definition of "Throughout," the Free Merriam-Webster Dictionary, Retrieved from http://www.merriam-webster.com/dictionary/throughout, Jun. 11, 2018, 15 pages.

European Search Report for Application No. EP18190846 dated Dec. 21, 2018, 10 pages.

European Search Report for European Application No. EP21166365.3, dated Jul. 21, 2021, 12 pages.

Examination Report for European Application No. 15725399.8, dated Jun. 4, 2019, 5 pages.

Examination Report dated May 11, 2018 for Australian Application No. 2015334902, 5 pages.

Examination Report dated Apr. 14, 2020 for Australian Application No. 2019200330, 7 pages.

Examination Report dated Dec. 22, 2017 for Australian Application No. 2015334902, 3 pages.

First Examination Report dated Dec. 11, 2019 for New Zealand Application No. 752875, 4 pages.

International Preliminary Report on Patentability for Application No. PCT/EP2015/074395, dated May 4, 2017, 7 pages.

International Preliminary Report on Patentability for Application No. PCT/EP2016/054159, dated Jul. 14, 2017, 7 pages.

International Preliminary Report on Patentability for Application No. PCT/EP2016/054232, dated Jul. 3, 2017, 28 pages.

International Preliminary Report on Patentability for Application No. PCT/EP2016/073472, dated Apr. 3, 2018, 9 pages.

(56) References Cited

OTHER PUBLICATIONS

International Preliminary Report on Patentability for Application No. PCT/GB2012/051257, dated Jul. 12, 2013, 20 pages.
International Preliminary Report on Patentability for Application No. PCT/EP2017/077633, dated May 16, 2019, 7 pages.
International Search Report and Written Opinion for Application No. PCT/GB2012/051257, dated Sep. 17, 2012, 22 pages.
International Search Report for Application No. PCT/EP2015/074395, dated Feb. 1, 2016, 2 pages.
International Search Report for Application No. PCT/EP2016/054159, dated Jun. 9, 2016, 3 pages.
International Search Report for Application No. PCT/EP2016/054232, dated Aug. 24, 2016, 5 pages.
International Search Report for Application No. PCT/EP2016/073472, dated Jan. 31, 2017, 3 pages.
International Search Report for Application No. PCT/GB2015/051253, dated Nov. 16, 2015, 6 pages.
International Written Opinion for Application No. PCT/EP2016/054159, dated Jun. 9, 2016, 7 pages.
International Written Opinion for Application No. PCT/EP2016/054232, dated Aug. 24, 2016, 8 pages.
JAC Vapour, "Round Rubber Mouth Tips," JAC Vapour E-Cigarettes & E-Liquids, retrieved from http://www.jacvapour.com/round-rubber-e-cig-mouth-tips on May 29, 2015, 2 pages.
Merriam-Webster Dictionary, Definition of "throughout," the Free Merriam-Webster Dictionary, Mar. 7, 2015, http://www.merriam-webster.com/dictionary/throughout, 15 pages.
Notice of Reasons for Refusal for Japanese Application No. 2018-152380, dated Jun. 30, 2020, 22 pages.
Office Action and Search Report dated Feb. 3, 2020 for Chinese Application No. 201680056939.7, 20 pages.
Office Action dated Aug. 24, 2020 for Chinese Application No. 201680056939.7, 33 pages.
Office Action dated Jun. 2, 2020 for Japanese Application No. 2017-545230, 5 pages.
Office Action dated Sep. 12, 2019 for Chinese Application No. 201680024542.X, 49 pages.
Office Action dated Sep. 12, 2019 for Chinese Application No. 201680024577.3, 21 pages.
Office Action dated May 15, 2018 for Japanese Application No. 2017-522122, 29 pages.
Office Action dated Mar. 16, 2018 for Canadian Application No. 2963957, 4 pages.
Office Action dated Jul. 2, 2018 for Chinese Application No. 201580023549.5, 23 pages.
Office Action dated Jul. 2, 2018 for Chinese Application No. 201580023949.5, 23 pages.
Office Action dated Jan. 21, 2020 for Japanese Application No. 2018-515290, 4 pages.
Office Action dated Mar. 23, 2020 for Brazilian Application No. 112017018446.0, 8 pages.
Office Action dated Apr. 25, 2018 for Korean Application No. 10-2017-7013874, 16 pages.
Office Action dated Apr. 26, 2016 for Korean Application No. 10-2017-7027341, 14 pages.
Office Action dated Jul. 30, 2019 for Japanese Application No. 2017-545230, 12 pages.
Office Action dated Oct. 30, 2018 for Japanese Application No. 2017-545245, 22 pages.
Office Action dated Oct. 30, 2018 for Korean Application No. 1020177013874, 19 pages.
Office Action dated Feb. 5, 2019 for Japanese Application No. 2017-522122, 14 pages.
Office Action dated Nov. 6, 2018 for Japanese Application No. 2017-545230, 10 pages.
Office Action dated May 7, 2019 for Japanese Application No. 2018-515290, 8 pages.
Partial International Search Report for Application No. PCT/EP2016/054232, dated Jun. 22, 2016, 6 pages.
Search Report for Russian Application No. 2018106929, dated Aug. 20, 2021, 2 pages.
Search Report dated Mar. 21, 2016 for Great Britain Application No. 1517470.9, 4 pages.
Search Report dated Apr. 23, 2015 for Great Britain Application No. 1418817.1, 5 pages.
Written Opinion for Application No. PCT/EP2015/074395, dated Feb. 1, 2016, 5 pages.
Written Opinion for Application No. PCT/EP2016/073472, dated Jan. 31, 2017, 8 pages.
Written Opinion for Application No. PCT/GB2015/051253, dated Nov. 16, 2015, 7 pages.
Written Opinion of the International Preliminary Examining Authority for Application No. PCT/GB2012/051257, dated May 29, 2013, 7 pages.
Office Action for Chinese Application No. 201780067522.5, dated Jan. 10, 2022, 6 pages.
Search Report dated Aug. 20, 2020 for Japanese Application No. 2019-522376, 36 pages.
Office Action for Canadian Application No. 3,042,128, dated Aug. 11, 2020, 6 pages.
Office Action for Chinese Application No. 201780067522.5, dated Jan. 8, 2021, 18 pages.
Office Action for Japanese Application No. 2019-522376, dated Sep. 1, 2020, 9 pages.
Office Action dated Dec. 5, 2019 for Russian Application No. 2019116869, 13 pages.
Anonymous: "iFUSE—the Heat not Burnhybrid—Heat not Burn" (https://heatnotburn.co.uk/ifuse-heat-not-burn-hybrid/), Jan. 4, 2018, 15 pages.
International Search Report and Written Opinion for International Application No. PCT/EP2019/070009, dated Nov. 6, 2019, 17 pages.
International Search Report and Written Opinion for International Application No. PCT/EP2019/070017, dated Dec. 2, 2019, 13 pages.
Notice of Reasons for Refusal for Japanese Application No. 2021-505274 dated Apr. 12, 2022, 9 pages.
Office Action for Russian Application No. 2021104828, dated Aug. 18, 2021, 17 pages.

* cited by examiner

AEROSOL PROVISION ARTICLE

CROSS REFERENCE TO RELATED APPLICATION

The present application is a National Phase entry of PCT Application No. PCT/EP2017/077633, filed Oct. 27, 2017 which claims priority from GB Application No. 1618481.4, filed Nov. 2, 2016, each of which is fully incorporated herein by reference.

TECHNICAL FIELD

The present disclosure relates to an aerosol provision article for use with an aerosol provision device for generating an inhalable medium.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine. As another example, there are so-called e-cigarette devices. These devices typically contain a liquid which is heated to vaporize the liquid to produce an inhalable vapor or aerosol. The liquid may contain nicotine and/or flavorings and/or aerosol-generating substances, such as glycerol. The known e-cigarette devices typically do not contain or use tobacco.

SUMMARY

According to a first aspect of the present disclosure, there is provided an aerosol provision article for use with an aerosol provision device for generating an inhalable medium comprising an aerosol, the aerosol provision article comprising: a first chamber for containing a first substance that is heatable to generate an aerosol; a conduit that extends through the first chamber, the conduit having an inlet through which aerosol generated from the first substance can enter the conduit and an outlet through which the aerosol can exit the conduit; a second chamber for receiving a second substance, wherein the second chamber is downstream of the outlet of the conduit, the article being arranged such that in use aerosol exiting the outlet of the conduit passes through the second substance received in the second chamber, and wherein the cross-sectional area of the conduit increases at or towards the outlet.

BRIEF DESCRIPTION OF THE DRAWINGS

Embodiments of the disclosure will now be described, by way of example only, with reference to the accompanying drawings, in which.

DETAILED DESCRIPTION

Figure 1:
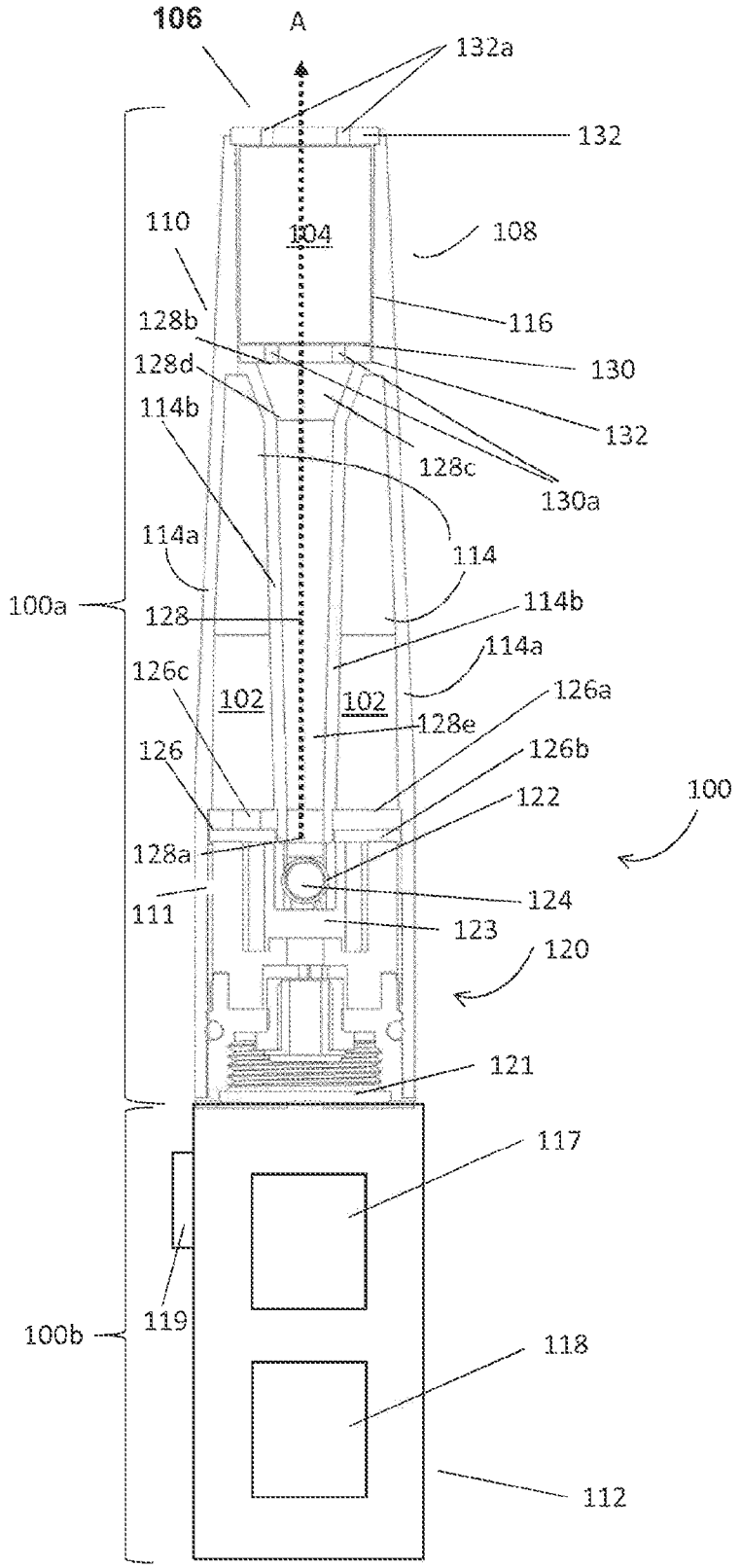
FIG. 1 shows a schematic longitudinal cross-sectional view of a first aerosol provision device for generating an inhalable medium.

Referring to FIG. 1, a schematic of an aerosol provision system 100 is illustrated. The aerosol provision system 100 is an inhalation device (i.e. a user uses it to inhale an aerosol provided by the system 100) and the system 100 is a hand held system. In this example, the system 100 is an electronic device, for example an electronic cigarette 100.

In broad outline, the system 100 volatilizes a first substance 102, for example, a liquid received in the system 100 to form a vapor and/or an aerosol which passes through a second substance 104 received in the system 100. In at least some examples a vapor is produced that then at least partly condenses to form an aerosol before exiting the system 100. The second substance 104 may impart to or modify a property, for example the flavor, of the vapor and/or aerosol before the vapor and/or aerosol passes through an outlet 106 of a mouth or proximal end 108 of the system 100 for inhalation by a user (not shown).

In this respect, first it may be noted that, in general, a vapor is a substance in the gas phase at a temperature lower than its critical temperature, which means that for example the vapor can be condensed to a liquid by increasing its pressure without reducing the temperature. On the other hand, in general, an aerosol is a colloid of fine solid particles or liquid droplets, in air or another gas. A "colloid" is a substance in which microscopically dispersed insoluble particles are suspended throughout another substance.

For reasons of convenience, as used herein the term aerosol should be taken as meaning an aerosol, a vapor or a combination of an aerosol and vapor.

Returning to FIG. 1, the system 100 of this example comprises an aerosol provision article 100*a* (referred to here-in below as a cartridge) comprising a first "upper" housing 110 and an aerosol provision device 100*b* comprising a second "lower" housing 112. In this example, the first housing 110 is releasably connectable to the lower housing 112.

The first housing 110 comprises a first chamber 114 for receiving the first substance 102 and a second chamber 116 for receiving the second substance 104.

The second housing 112 contains a battery 117 for powering various components of the system 100, as will be discussed further below. The battery 117 may be a rechargeable battery or a disposable battery. A controller 118, which may comprise a micro-chip and associated circuitry is also provided in the second housing 112 for controlling the operation of various components of the system 100, as will be discussed further below. A user input means 119, for example one or more control buttons, may be provided on the exterior of the second housing 112 for a user to operate the controller 118.

The first housing 110 defines the proximal end 108 of the system 100 and at an opposite end a base section 120 that connects to the second housing 112. To that end, the base section 120 comprises a connector part 121, for example, a screw thread (as is illustrated) or a bayonet fit for releasably connecting the first housing 110 to the second housing 112. The first housing 110 may further comprise one or more air inlets 111.

The first chamber 114 may take various different forms. In the example of FIG. 1, the first chamber 114 is in the form of an annular chamber which extends axially in the first housing 110 between the proximal end 108 and the base section 120. The annular first chamber 114 comprises an outer wall 114*a* of the first housing 110, an inner wall 114*b* of the first housing 110 and an annular end portion 126 that together define an annular space for containing the first substance 102.

A heater 122 is provided in the base section 120 of first housing 110 below the first chamber 114. The heater 122 is powered by the battery 117 and is therefore electrically connected to the battery 117. The heater 122 is provided for volatilizing the first substance 102 received in the first chamber 114.

In this example, the first substance is a liquid 102. The liquid 102 is preferably a liquid that is volatilizable at reasonable temperatures, preferably in the range of 100-300° C. or more particularly around 150-250° C., as that helps to keep down the power consumption of the system 100. Suitable materials include those conventionally used in e-cigarette devices, including for example propylene glycol and glycerol (also known as glycerine).

The heater 122 may be an electrically resistive heater, including for example a nichrome resistive heater, a ceramic heater, etc. The heater 122 may be for example a wire, which may for example be in the form of a coil (as illustrated) a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. Other heating arrangements may be used, including non-electrical heating arrangements, or other electrical heating arrangements, such as induction heating.

In the example shown, the heater 122 surrounds a wick 124 which is in (thermal) contact with the heater 122. The wick 124 is also in fluidic contact with the liquid 102 contained in the first chamber 114. The wick 124 is generally absorbent and acts to draw in liquid 102 from the first chamber 114 by capillary action.

In this example, this is achieved by the wick 124 being in contact with the annular end portion 126 that is an end of the first chamber 114 and which is above the heater 122 and the wick 124. The end portion 126 comprises a first annular plate 126*a* and a second annular plate 126*b*. The first annular plate 126*a*, for example a plastic plate, is between the end of the first chamber 114 and the second annular plate 126*b* and comprises at least one aperture 126*c* that enables liquid 102 within the annular first chamber 114 to contact the second annular plate 126*b*. The second annular plate 126*b* is a permeable member that enables fluid to pass in a regulated manner from the first chamber 114 to the wick 124 which is in contact with the second annular plate 126*b*. The second annular plate 126*b* may be for example a ceramic woven sheet formed (e.g. cut) into an annular shape or alternatively could be formed from a polymer.

The wick 124 is preferably non-woven and may be for example a cotton or wool material or the like, or a synthetic material, including for example polyester, nylon, viscose, polypropylene or the like, or a ceramic material.

The base section 120 further contains a block 123 of heat insulating material for insulating the heater 122. The block 123 may also support the heater 122 and wick 124 to retain them in place.

The first housing 110 further comprises an elongate conduit 128 that extends axially through the first chamber 114 to provide a flow path for aerosol generated when the heater 122 heats the wick 124. In this example, the elongate conduit 128 is an opened ended bore defined by the inner wall 114*b* of the first chamber 114 and is aligned substantially along a central longitudinal axis of the first housing 110.

The conduit 128, which in this example is circular in cross section at any point along its length, comprises a conduit inlet 128*a* just downstream of the heater 122 and wick 124 arrangement and a conduit outlet 128*b* just upstream of the second chamber 104. The conduit 128 flares or widens along its length so that the cross-sectional area of the conduit 128 increases along the length of the conduit from the inlet 128*a* to the outlet 128*b*. In the region of the second chamber 104 the rate of widening of the conduit 128 increases sharply so that at the conduit outlet 128*b*, the cross sectional area of the conduit 128 is very similar in size to the cross sectional area of the second chamber 104.

In this example, the cross sectional area of the outlet 128*b* of the conduit is at least 70% and for example at least 90% of the cross sectional area of the second chamber 116.

Accordingly, in this example the conduit 128 is widest at the outlet 128*b* and is narrowest at the inlet 128*a*.

Furthermore, the conduit 128 comprises a first section 128*c* that tapers from the outlet 128*b* to a first point 128*d* along the conduit at a first rate and a second section 128*e* that tapers from the first point towards the inlet 128*a* at a second rate that is lower than the first rate. This geometry helps maintain a good flow of aerosol whilst enabling a relatively large amount of liquid to be stored in the first chamber 114.

In an alternative arrangement, the width (and/or cross-sectional area) of the conduit 128*a* is substantially constant along its length from the inlet 128*a* to the first point 128*d*.

Whilst this will be described more fully below, in use, liquid 102 drawn into the wick 124 is heated by the heater 122 and is volatilized so as to produce an aerosol that exits the wick 124 and flows through the conduit 128 towards the proximal end 108 as shown by the arrows A under the action of the user drawing on the proximal end 108. The heater 122 and wick 124 may be provided as a single, effectively integral item such that the heating and wicking is effectively carried out by a single unit.

The second chamber 104 is in the proximal end 108 of the system 100 immediately downstream of the conduit outlet 128*a*. More specifically, in this example, the second chamber 104 is a cylindrical bore defined by the proximal end 108. The first housing 110 further contains a base plate 130 that is within the chamber 104 and acts as a base of the chamber 104. In this example, the base plate 130 is supported by or attached to an internal lip 132 formed around a bottom of the chamber 104 and defined by the inner wall 114*a* of the first housing 110. The base plate 130 comprises one or more through holes 130*a* which enable aerosol to flow from the conduit 128 into the second chamber 104.

The system 100 further comprises a plate 132 that can be releasably attachable to an open end of the proximal end 108 and acts as a cap to the outlet of the proximal end 108. The plate 132 also comprises one or more through holes 132*a* which enable aerosol to flow from the second chamber 104 onwards or into the mouth of a user.

In use, if the plate 132 is releasable, a user can access the second chamber 116 to replace or replenish the second substance 104 through the open end 3 of the housing 2 by removing the plate 132.

The second substance 104 is a substance that may be used to impart a flavor to the aerosol produced from the liquid 128 as the aerosol passes through the second substance 104. The second substance 104 may for example consist of or comprise tobacco. As the aerosol passes through and over the tobacco 104, the aerosol entrains organic and other compounds or constituents from the tobacco material 104 that lend tobacco its organoleptic properties, thus imparting the flavor to the aerosol as it passes through the second chamber 116.

It will be understood however that materials other than tobacco may be used to impart different flavors to the aerosol.

In addition, where the second substance 104 is or includes tobacco, it may be that the aerosol stream draws sufficient nicotine from the second substance 104. Alternatively or additionally, where the second substance 104 does not contain any tobacco, the second substance 104 may be enhanced with nicotine, for example by coating the material with nicotine. Indeed, even in the case that the second substance 104 is or includes tobacco, the second substance 104 may be coated or otherwise enhanced with nicotine. As another example, whether or not the second substance 104 is or includes tobacco and/or includes nicotine, nicotine may be provided in the liquid 102. Accordingly, where it is intended that the system 100 provides nicotine for the user, the nicotine may be provided in the liquid 102, may be obtained from the second substance 104 in the case that the material is or includes tobacco, may be provided as a coating or the like on second substance 104 if it is non-tobacco material, may be provided as a coating or the like on the second substance 104 if it is tobacco material, or any combination of these. Likewise, flavorings may be added to the second substance 104 (whether or not the material is or includes tobacco) and/or to the liquid 102.

Accordingly, in use, as a user draws on the proximal end 108, air is drawn through the one or more air inlets 111. The heater 122 is powered by the user operating the control button (or alternatively by a puff detector (not shown), as is known per se) and liquid 102 drawn in from the first chamber 114 by the wick 124 is heated by the heater 122 to volatilize the liquid 102 so as to generate the aerosol into the air from the air inlet 111 to produce a flow of aerosol. The flow of aerosol is drawn through the conduit 128 and through the second chamber 116 and then out of the system 100 for inhalation by the user.

Advantageously, the shape of the outlet 128*b* of the conduit 128 as described above ensures that the flow of the aerosol passes through a majority of the cross-sectional area of the second chamber 116 and hence through most of the second substance 104.

As mentioned above, heating devices are known that release compounds by heating, but not burning, tobacco. It may be noted here that tobacco is a poor heat conductor, and yet the heating of tobacco in known tobacco heating devices is by heat conduction through the tobacco from an exterior surface of the tobacco (typically by virtue of an electrical resistive heating element which is in contact with the surface of the tobacco). This means that the tobacco may be heated inefficiently and/or the power consumption of the device is high. In the case of a battery-operated device, high power consumption is a problem for the user as the battery or batteries need to be recharged or replaced frequently. In the case that the second substance 104 is tobacco, this can be avoided in embodiments of the system 100 as the second substance 104 can be heated by the hot aerosol passing through the body of the porous second substance 104 providing for more effective and efficient heating throughout the body of the second substance 104. This can help to lower the power consumption of the system 100.

In the example shown in FIG. 1, the only heat source for heating the second substance 104 in the system 100, which is required so as to generate the organic and other compounds or constituents from the second substance 104, is the hot aerosol produced from heating the liquid 102.

In some cases, it may be that the user only needs to top up or replace the second substance 104 from time to time, with sufficient liquid 102 being provided for several uses. Once the liquid 102 has been consumed, the user disposes of the aerosol provision article 100 and then uses a new one.

In other cases, the upper housing 110 is not designed to be disposable and instead the user only needs to top up or replace the liquid 102 from time to time.

In some examples, the upper housing 110 may itself be housed within an outer housing (not shown) that is part of the aerosol provision device 100*b* and which also connects to the lower housing 112. The aerosol provision device 100*b* may be provided with a mouth piece section.

Figure 2:
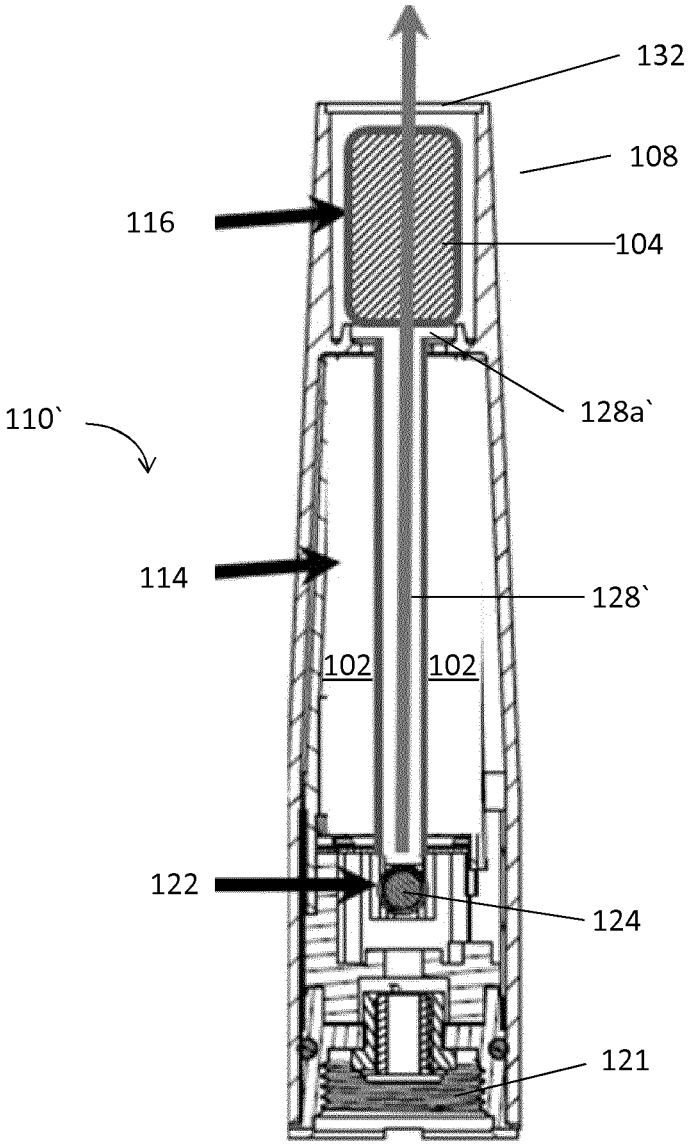
FIG. 2 shows a schematic longitudinal cross-sectional view of an aerosol provision article for an aerosol provision device for generating an inhalable medium.

Referring now to FIG. 2, there is shown another example of an aerosol provision article 110' that can be used in the aerosol provision system 100 of FIG. 1 in place of the aerosol provision article 110. In the following description and in FIG. 2, components and features that are the same as or similar to the corresponding components and features of the example described with reference to FIG. 1 have the same reference numeral. For the sake of brevity, the description of those components and features will not be repeated here.

In this example, the conduit 128' for the aerosol flow has a substantially constant cross-sectional area along the majority of its length but at the point immediately upstream of the second chamber 116, the outlet 128*b*' of the conduit 128' has a step increase in the cross-sectional area (and diameter) of the conduit 128'. In this example, the cross sectional area of the outlet 128*b*' of the conduit is at least 80% and for example at least 90% of the cross-sectional area of the second chamber 116.

Again, the shape of the outlet 128*a*' of the conduit 128' ensures that the flow of the aerosol passes through a majority of the cross-sectional area of the second chamber 116 and hence through most of the second substance 104.

In this example, the wall of the outlet of the conduit 128' also serves to support the second substance 104 in place in the second chamber 116. The outlet of the conduit 128' may be provided with a mesh or grill or the like to prevent any of the second substance 104 dropping into the conduit 128'.

As an alternative to any of the arrangements discussed above, the heater for the liquid may be provided separately of the liquid and second substance chambers. The heater may for example be provided as part of the second housing 112 of the overall system 100 to which the cartridge is detachably fitted by the user in use.

A number of other variations and alternatives to the examples described above are possible.

As another example, the second substance may be omitted from the second chamber, for example at the option of the user. This provides the user with more flexibility over the use of the cartridge as the user can use the cartridge as a classic "e-cigarette" device, only vaporizing liquid and not having the aerosol pass over or through solid material, from time to time if they choose.

In the examples described above, the system controller controls operation of the system as a whole. The controller for example may cause the heating element to be powered as and when required and switch off the heating element when heating is not required. Operation of the heating element may be controlled so that the liquid is heated to an optimum temperature. Particular considerations include ensuring that the material does not burn, ensuring that adequate vaporization of the liquid is achieved, ensuring that the vaporized liquid or aerosol is at an appropriate temperature to liberate compounds from the material, and ensuring that the vapor or aerosol that reaches the user is at a comfortable and safe temperature. A puff detector, a device which is known per se, may be provided to signal to the controller when the one or more heating elements need to be energized. The system may also have one or more filters for filtering the vapor or aerosol before it reaches the user, cooling arrangements for cooling the vapor or aerosol before it reaches the user, insulation internally of the system to protect the user from the heat generated inside the housing, etc.

In use, and particularly in the case that the second substance is tobacco, it is preferred that the tobacco, or at least the surface of the tobacco, be heated to a temperature of between around 190° C. to 210° C. and most preferably around 200° C. so as to ensure that an adequate or appropriate amount of the compounds are released from the tobacco. The amount of tobacco present may be for example in the range 50 to 300 mg or so. A most suitable value for the amount of tobacco may be for example in the range 50 to 150 mg, with 130 mg being a value that is currently found to be particularly suitable in some applications. In a typical example, the amount of tobacco that is heated per operation of the system (i.e. per puff) may be in the corresponding range of around 8 to 50 mg.

In use, the liquid 10, 210, etc. may be heated to a temperature of between around 100-300° C. or more particularly around 150° C. to 250° C.

Suitable second substance materials 104, etc. include materials that provide volatilized components upon heating, typically in the form of an aerosol. Suitable materials 104, etc. include any tobacco-containing material and may, for example, include one or more of tobacco per se, different varieties of tobacco, tobacco derivatives, expanded tobacco, reconstituted tobacco, ground tobacco, tobacco extract, homogenized tobacco or tobacco substitutes. In the case of tobacco, the second substance 104, etc. may be in the form of a rod of tobacco, a pod or plug of tobacco, loose tobacco, agglomerates, etc., and may be in relatively dry form or in relatively moist form for example. Suitable second substances 104, etc. may include other, non-tobacco, products, which, depending on the product, may or may not contain nicotine.

Although in the examples described above, the second substance 104 is for modifying a flavor of the aerosol when the aerosol flows through the second substance 104, this is not essential and instead (or in addition) the second substance 104 may be for modifying a property of the aerosol other than (or in addition) to flavor.

In some examples, the second substance 104 may be or include a substance that modifies one or more other organoleptic properties of the aerosol (e.g. modifying the feel or smell or look of the aerosol to the user).

In some examples, the second substance 104 may be or include a substance that modifies the PH of the aerosol by either lowering or raising the PH (e.g. modifying the acidity or the basicity of the aerosol).

In some examples, the second substance 104 may be or include a substance that modifies (e.g. reduces) the amount of aldehydes in the aerosol.

In some examples, the second substance 104 may be or include a substance that modifies different combinations of two or more of these or indeed other properties of the aerosol.

In the particular case that the second substance 104 is tobacco, the tobacco may be in the form of a plug of tobacco rod which is cut to length and placed into the receptacle or container for the solid material before the receptacle or container for the solid material is combined with the liquid container (whether the receptacle or container for the solid material is combined with the liquid container during manufacture or by the user in use).

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In order to address various issues and advance the art, the entirety of this disclosure shows by way of illustration and example various embodiments in which the claimed invention may be practiced and which provide for a superior system arranged to generate an inhalable medium. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An aerosol provision article for use with an aerosol provision device for generating an inhalable medium comprising an aerosol, the aerosol provision article comprising:

a first chamber for containing a first substance that is heatable to generate an aerosol, wherein the first substance is a liquid;

a conduit that extends through the first chamber, the conduit having an inlet through which aerosol generated from the first substance can enter the conduit and an outlet through which the aerosol can exit the conduit, wherein the conduit comprises a first section that tapers from the outlet towards the inlet;

a second chamber for receiving a second substance, wherein the second chamber is downstream of the outlet of the conduit, the aerosol provision article being arranged such that in use aerosol exiting the outlet of the conduit passes through the second substance received in the second chamber, and wherein a cross-sectional area of the conduit increases at or towards the outlet; and a wick for wicking the first substance out of the first chamber in use.

2. The aerosol provision article according to claim 1, wherein the cross-sectional area of the conduit at the outlet is greater than the cross-sectional area of any other section of the conduit.

3. The aerosol provision article according to claim 1, wherein the first chamber is substantially annular.

4. The aerosol provision article according to claim 1, wherein the second chamber is in a proximal end of the aerosol provision article.

5. The aerosol provision article according to claim 1, further comprising a heater associated with the first chamber for volatilizing the liquid held in the first chamber in use.

6. The aerosol provision article according to claim 1, wherein the first chamber has one or more apertures to allow liquid to exit the first chamber.

7. The aerosol provision article according to claim 1, wherein the first chamber and the conduit are molded as an integral component.

8. The aerosol provision article according to claim 1, wherein the second chamber contains the second substance and the second substance is a solid material.

9. The aerosol provision article according to claim 8, wherein the solid material is or comprises tobacco.

10. The aerosol provision article to claim 1, wherein a cross-sectional area of the outlet of the conduit is at least 70% of a cross-sectional area of the second chamber.

11. An aerosol provision article for use with an aerosol provision device for generating an inhalable medium comprising an aerosol, the aerosol provision article comprising:

a first chamber for containing a first substance that is heatable to generate an aerosol, wherein the first substance is a liquid;

a conduit that extends through the first chamber, the conduit having an inlet through which aerosol generated from the first substance can enter the conduit and an outlet through which the aerosol can exit the conduit, wherein the conduit comprises a first section that tapers from the outlet towards the inlet; and a second chamber for receiving a second substance, wherein the second chamber is downstream of the outlet of the conduit, the aerosol provision article being arranged such that in use aerosol exiting the outlet of the conduit passes through the second substance received in the second chamber, and wherein a cross-sectional area of the conduit increases at or towards the outlet, wherein:

the first section tapers from the outlet to a first point along the conduit at a first rate and the conduit comprises a second section that tapers from the first point towards the inlet at a second rate that is lower than the first rate, or the first section tapers from the outlet towards a first point along the conduit at a first rate and the conduit comprises a second section that extends from the first point towards the inlet and has a substantially constant width.

12. A system comprising:

an aerosol provision device for generating an inhalable medium comprising an aerosol, the aerosol provision device having a battery section; and an aerosol provision article for use with the aerosol provision device, the aerosol provision article comprising:

a first chamber for containing a first substance that is heatable to generate an aerosol, wherein the first substance is a liquid;

a conduit that extends through the first chamber, the conduit having an inlet through which aerosol generated from the first substance can enter the conduit and an outlet through which the aerosol can exit the conduit, wherein the conduit comprises a first section that tapers from the outlet towards the inlet; and a second chamber for receiving a second substance, wherein the second chamber is downstream of the outlet of the conduit, the aerosol provision article being arranged such that in use aerosol exiting the outlet of the conduit passes through the second substance received in the second chamber, and wherein a cross-sectional area of the conduit increases at or towards the outlet, wherein the aerosol provision article is connectable to the aerosol provision device.

13. An aerosol provision device for generating an inhalable medium comprising an aerosol, the aerosol provision device comprising:

a first chamber for containing a first substance that is heatable to generate an aerosol, wherein the first substance is a liquid;

a conduit that extends through the first chamber, the conduit having an inlet through which aerosol generated from the first substance can enter the conduit and an outlet through which the aerosol can exit the conduit, wherein the conduit comprises a first section that tapers from the outlet towards the inlet;

a second chamber for receiving a second substance, wherein the second chamber is downstream of the outlet of the conduit, the aerosol provision device being arranged such that in use aerosol exiting the outlet of the conduit passes through the second substance received in the second chamber, and wherein a cross-sectional area of the conduit increases at or towards the outlet; and a wick for wicking the first substance out of the first chamber in use.

14. The aerosol provision device according to claim 13, wherein the cross-sectional area of the conduit at the outlet is greater than the cross-sectional area of any other section of the conduit.

15. The aerosol provision device according to claim 13, wherein the first chamber is substantially annular.

16. The aerosol provision device according to claim 13, wherein the second chamber is in a proximal end of the aerosol provision device.

17. The aerosol provision device according to claim 13, further comprising a heater associated with the first chamber for volatilizing the first substance held in the first chamber in use.

18. The aerosol provision device according to claim 13, wherein the first chamber has one or more apertures to allow the first substance to exit the first chamber.

19. The aerosol provision device according to claim 13, wherein the first chamber and the conduit are molded as an integral component.

20. The aerosol provision device according to claim 13, wherein the second chamber contains the second substance and the second substance is a solid material.

21. The aerosol provision device according to claim 20, wherein the solid material is or comprises tobacco.

22. The aerosol provision device according to claim 13, wherein a cross-sectional area of the outlet of the conduit is at least 70% of a cross-sectional area of the second chamber.

23. An aerosol provision device for generating an inhalable medium comprising an aerosol, the aerosol provision device comprising:

a first chamber for containing a first substance that is heatable to generate an aerosol, wherein the first substance is a liquid;

a conduit that extends through the first chamber, the conduit having an inlet through which aerosol generated from the first substance can enter the conduit and an outlet through which the aerosol can exit the conduit, wherein the conduit comprises a first section that tapers from the outlet towards the inlet; and a second chamber for receiving a second substance, wherein the second chamber is downstream of the outlet of the conduit, the aerosol provision device being arranged such that in use aerosol exiting the outlet of the conduit passes through the second substance received in the second chamber, and wherein a cross-sectional area of the conduit increases at or towards the outlet, wherein:

the first section tapers from the outlet to a first point along the conduit at a first rate and the conduit comprises a second section that tapers from the first point towards the inlet at a second rate that is lower than the first rate, or the first section tapers from the outlet towards a first point along the conduit at a first rate and the conduit comprises a second section that extends from the first point towards the inlet and has a substantially constant width.

* * * * *